US008425137B1

(12) United States Patent
Sampaio

(10) Patent No.: US 8,425,137 B1
(45) Date of Patent: Apr. 23, 2013

(54) DOUBLE SIDED SPRAY MOP

(75) Inventor: Andre Sampaio, Valley Cottage, NY (US)

(73) Assignee: Casabella Holdings, LLC, Congers, NY (US)

( * ) Notice: Subject to any disclaimer, the term of this patent is extended or adjusted under 35 U.S.C. 154(b) by 0 days.

(21) Appl. No.: 13/473,235

(22) Filed: May 16, 2012

Related U.S. Application Data

(60) Provisional application No. 61/597,548, filed on Feb. 10, 2012.

(51) Int. Cl.
*A47L 13/26* (2006.01)

(52) U.S. Cl.
USPC ..... 401/139

(58) Field of Classification Search ..... 401/136–140
See application file for complete search history.

(56) References Cited

U.S. PATENT DOCUMENTS 5,461,749 A 10/1995 Ahlberg et al.
5,779,155 A * 7/1998 Schennum et al. ..... 239/333
5,988,920 A * 11/1999 Kunkler et al. ..... 401/138
6,497,525 B1 * 12/2002 Huang ..... 401/138
6,722,806 B2 * 4/2004 Kunkler et al. ..... 401/138
6,871,372 B2 3/2005 Vosbikian et al.
7,735,182 B2 6/2010 Morris et al.
7,854,035 B2 12/2010 Gullicks et al.
2003/0180083 A1 * 9/2003 Hall et al. ..... 401/140

* cited by examiner

*Primary Examiner* — Huyen Le

(74) *Attorney, Agent, or Firm* — Curtis, Mallet-Prevost, Colt & Mosle, LLP

(57) ABSTRACT

A double sided spray mop is disclosed that has a cleaning head with a bottom head and a top head, at least one push fit zipper, and a nozzle protruding from an edge of the cleaning head for delivery of a cleaning solution. The double sided spray mop further has a body for receiving a bottle of cleaning solution and a manual pump housed within the body for delivering cleaning solution to the nozzle. A universal joint couples the body to the cleaning head. A pole is connected to the body and contains a pusher rod that mechanically couples a trigger and a linkage, the linkage being mechanically coupled to the pump such that movement of the trigger translates to actuation of the pump.

20 Claims, 19 Drawing Sheets

DOUBLE SIDED SPRAY MOP

This request for prioritized examination claims priority to U.S. provisional Appln. No. 61/597,548, filed on Feb. 10, 2012.

BACKGROUND OF THE INVENTION

1. Field of the Invention

This invention relates generally to cleaning devices, and more specifically to a double sided spray mop.

2. Description of Related Art

Mops have been used for many years to clean hard surface floors and related surfaces. The cleaning solution is typically located in a bucket and the mop is placed in the bucket for application of the cleaning solution. Use of a bucket for dispensing of cleaning solution is cumbersome and prone to spills and non-hygienic distribution of dirt and particles in the cleaning solution. In recent years, cleaning solution dispensing mops have become popular. These mops contain a small bottle of cleaning solution and a dispensing apparatus to deliver the cleaning solution in front of the head of the mop in use. Oftentimes the mop head contains a disposable cleaning sheet that can be removed and discarded when soiled. These disposable cleaning sheets are retained in place by use of various devices such as friction fit openings, clamps, or hook and loop fasteners. The use of disposable cleaning sheets, while convenient, represents a continuous and ongoing cost. Many of these disposable cleaning sheets also contain plastic or synthetic components as well as cleaning solution, and represent a waste stream that is not at all advantageous to our environment. In many of these mops, a removable and disposable cleaning surface typically makes contact with a generally flat bottomed cleaning head that is in turn attached to a handle. Such an arrangement, while adequate, does not provide an optimal cleaning surface. This is due in part to the flat nature of the contact surface of the cleaning head. While the flat surface of the bottom of such cleaning heads glides smoothly across a flat surface to be cleaned, such as a floor, it lacks the frictional and structural features necessary to provide improved cleaning.

In addition, some of these cleaning solution dispensing mops contain an electric pump to transfer the cleaning solution from a cleaning solution storage bottle to a nozzle that then distributes the cleaning solution on the surface to be cleaned. The use of an electric pump, while convenient, requires the use of batteries that add to the ongoing expense of the cleaning solution dispensing mop and also are not an environmentally responsible approach to cleaning due to the toxic nature of batteries and the associated disposal of them. Further, the use of an electric pump and the associated electrical components required for operation represents another potential point of failure for the mop, especially given exposure to a wet environment and associated cleaning solutions.

What is needed is a cleaning solution dispensing mop with a plurality of cleaning edges to increase the cleaning ability of the mop and further that has additional attributes to compliment and enhance the efficacy of the cleaning edges and surfaces.

What is also needed is a mop that precisely dispenses the cleaning solution without requiring a bucket or an electric pump and associated batteries and electronics. A cleaning head that has a cleaning material such as a micro fiber sheet or pad and is also double sided would provide further benefits.

It is thus an object of the present invention to provide a double sided spray mop that has a novel cleaning solution dispensing system. It is another object of the present invention to provide a double sided spray mop that has a novel double sided cleaning head. It is another object of the present invention to provide a double sided spray mop that has a novel cleaning head and handle arrangement.

These and other objects of the present invention are not to be considered comprehensive or exhaustive, but rather, exemplary of objects that may be ascertained after reading this specification and claims with the accompanying drawings.

BRIEF SUMMARY OF THE INVENTION

In accordance with the present invention, there is provided a double sided spray mop comprising a cleaning head having a bottom head, a top head having at least one push fit zipper, a universal joint cleaning head part, and a nozzle protruding from an edge of the cleaning head for delivery of a cleaning solution; a body having a bottle opening, a universal joint body part, a body lever, and a bottle coupler receiver; the universal joint body part being mechanically coupled to the universal joint cleaning head part; a pole connected to the body; a pump housed within the body and in fluid communication between the bottle coupler receiver and the nozzle for delivery of a cleaning solution; and a pusher rod placed between a trigger and a linkage, the linkage being mechanically coupled to the pump such that movement of the trigger translates to actuation of the pump.

The foregoing paragraph has been provided by way of introduction, and is not intended to limit the scope of the invention as described in this specification, claims and the attached drawings.

BRIEF DESCRIPTION OF THE DRAWINGS

The invention will be described by reference to the following drawings, in which like numerals refer to like elements, and in which.

Figure 1:
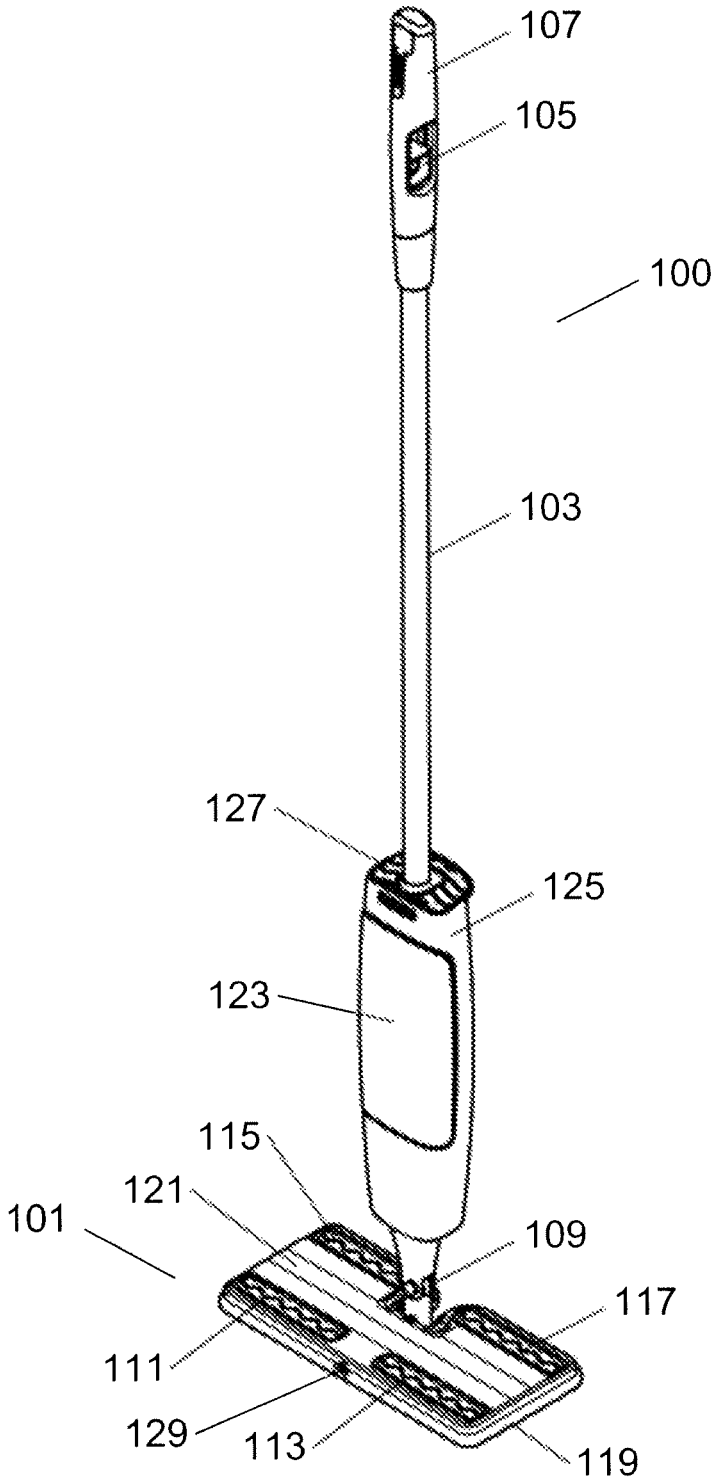
FIG. 1 is a perspective view of the double sided spray mop.

The attached figures depict various views of the double sided spray mop in sufficient detail to allow one skilled in the art to make and use the present invention. These figures are exemplary, and depict a preferred embodiment; however, it will be understood that there is no intent to limit the invention to the embodiment depicted herein. On the contrary, the intent is to cover all alternatives, modifications, and equivalents as may be included within the spirit and scope of the invention as defined by this specification, claims and drawings.

DESCRIPTION OF THE PREFERRED EMBODIMENTS

A Double Sided Spray Mop is described and depicted by way of this specification and the attached drawings. The term spray mop, as used herein, refers to a cleaning device that has the capability to deliver a liquid to aid in the process of cleaning with the device.

For a general understanding of the present invention, reference is made to the drawings. In the drawings, like reference numerals have been used throughout to designate identical elements.

Referring to FIG. 1, a perspective view of the Double Sided Spray Mop 100 is shown. Depicted is a cleaning head 101 that is also shown in FIGS. 6-17 in further detail. The cleaning head 101 comprises a bottom head 119 and a top head 121. The top head 121 may be made from a material such as a rigid material, for example a plastic or a metal. Examples of suitable plastics include acrylonitrile butadiene styrene (ABS), polyethylene, polypropylene, polystyrene, polyvinyl chloride, polytetrafluoroethylene, and the like. Bioplastics may also be used in some embodiments of the present invention. In addition, reinforced plastics, metals, and other materials that may be suitably formed may also be used. The top head 121 may be made by injection molding, blow molding, machining, or the like. Attached to the top head 121 is a bottom head 119. The bottom head 119 may be made from a material that has resilient characteristics, such as a closed cell or an open cell foam. An example of a suitable foam is Ethylene Vinyl Acetate foam. The bottom head 119 may be molded, machined, or the like. In some embodiments of the present invention, the bottom head 119 has a plurality of ridges, such as, but not limited to, the ridges depicted in FIG. 16. The ridges provide both frictional and structural attributes necessary to provide improved cleaning over a standard planar structure without such features. The ridges traverse the length of the bottom head 119, and may also have additional structural features or geometries. In some embodiments of the present invention, the head 121 may also have a plurality of ridges. The bottom head 119 and the top head 121 are joined as depicted in FIG. 1 using a suitable adhesive, or they may be over molded, thermo fused, sonically welded, heat welded, solvent welded, or the like. Several push fit zippers can also be seen in FIG. 1. The top head 121 has at least one push fit zipper. In the example provided by way of FIG. 1, a first push fit zipper 111, a second push fit zipper 113, a third push fit zipper 115 and a fourth push fit zipper 117 are depicted. The push fit zippers are essentially soft durometer materials with a curvilinear or otherwise non-linear opening. The curvilinear or otherwise non-linear opening may be, for example, an opening that resembles a sinusoid or a sine curve (a generally sinusoidal opening). A suitable material for the push fit zipper being, for example, thermoplastic rubber. The opening of each push fit zipper serves to retain a cleaning pad such as a disposable cleaning pad, a micro fiber cleaning pad, or the like. The push fit zippers are contained in openings in the top head 121, and may be over molded into the openings, or fastened by a suitable adhesive, or they may be thermo fused, sonically welded, heat welded, solvent welded, or the like. The curvilinear or otherwise non-linear opening in the push fit zipper provides a reticulated opening that retains a cleaning pad. The cleaning head 101 also has a nozzle 129, such as a spray nozzle, protruding or otherwise integrated into an edge of the cleaning head 101 for delivery of a liquid such as a cleaning solution. The nozzle 129 is in fluid communication with a bottle 123 that contains a liquid, the fluid communication and delivery of the liquid being by way of a pump housed within the body 125. The body 125 has a bottle opening for retention of a bottle 123, a universal joint body part 1805 (see FIG. 18), a body lever 127, and a bottle coupler receiver 1903 (see FIG. 19). The body 125 may be made from a rigid material, for example a plastic or a metal. Examples of suitable plastics include acrylonitrile butadiene styrene (ABS), polyethylene, polypropylene, polystyrene, polyvinyl chloride, polytetrafluoroethylene, and the like. Bioplastics may also be used in some embodiments of the present invention. In addition, reinforced plastics, metals, and other materials that may be suitably formed may also be used. The bottle 123 can be seen retained by, and otherwise mechanically coupled or retained by the body 125. The bottle 123 will be further depicted in FIGS. 22-28 such that the retention mechanisms, form and geometric attributes, and liquid delivery mechanisms, will be fully described by way of example, and not limitation. The bottle body lever 127 has at least one actuator tab 1807, 1809, for example (see FIG. 18) that couples to a retention slot in the bottle (see FIGS. 24, 2401 and 2403), and also is hingeably connected to the body such that when the body lever 127 is depressed or otherwise moved, at least one push lever such as 201 (see FIG. 2) and 401 (see FIG. 4) will push at least part of the bottle 123 out of the body 125 for subsequent replacement, refilling, or the like. The cleaning head 101 is attached to a body 125 by way of a universal joint 109. The body 125 is in turn attached to a pole 103, the pole being made from a rigid material such as steel, a plastic, fiberglass, or the like. Further, the pole 103 is at least partially hollow to accommodate mechanical components such as a pusher rod (not shown in FIG. 1, see FIG. 5). The universal joint 109 has several components that include a universal joint cleaning head part 801 (see FIG. 8) and a universal joint body part 1805 (see FIG. 18). Other parts of the universal joint 109, such as the universal joint axle 1301, a first cam 1303 and a second cam 1305, all depicted in FIG. 13, will become evident in both form and purpose upon further review of this specification. Also depicted in FIG. 1, and as will be further described and depicted herein, a pump (not seen in FIG. 1, see FIGS. 29 and 30) is housed within the body 125 and is in fluid communication between the bottle 123 (by way of a bottle coupler receiver 1903, not shown in FIG. 1, see FIG. 19) and nozzle 129. The pole 103 may, in some embodiments, have a handle 107 that may further contain a trigger 105. The trigger 105 and the handle may be made from a material such as a rigid material, for example a plastic or a metal. Examples of suitable plastics include acrylonitrile butadiene styrene (ABS), polyethylene, polypropylene, polystyrene, polyvinyl chloride, polytetrafluoroethylene, and the like. Bioplastics may also be used in some embodiments of the present invention. In addition, reinforced plastics, metals, and other materials that may be suitably formed may also be used. The trigger 105, as will be further described, is mechanically coupled to a pump (see FIGS. 29 and 30) by way of a pusher rod and related linkage (see FIGS. 30 and 31) such that the movement of the trigger 105 in turn moves a push stem, valve, plunger, piston, impeller, diaphragm, or similar positive displacement structure that in turn moves the liquid from the bottle 123 to the nozzle 129.

Figure 2:
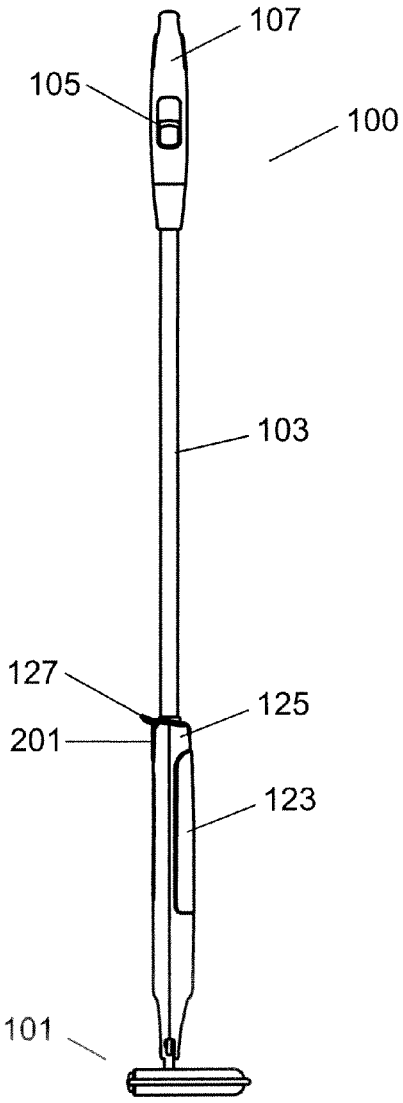
FIG. 2 is a side plan view of the double sided spray mop.

FIG. 2 is a side plan view of the double sided spray mop where the cleaning head 101 can be seen attached to the body 125. The trigger 105 and handle 107 can also be seen. The trigger 105, in some embodiments of the present invention, is integrated within the handle 107 such that the handle 107 surrounds the trigger 105. The trigger 105 may also be circular, or have a square shaped opening, and may travel in a linear direction within the handle 107 in use. The opening in the handle 107 that accommodates the trigger 105 may be rectangular, circular, elliptical, or may generally rectangular with one or more sides being arced or otherwise having a curve.

Figure 3:
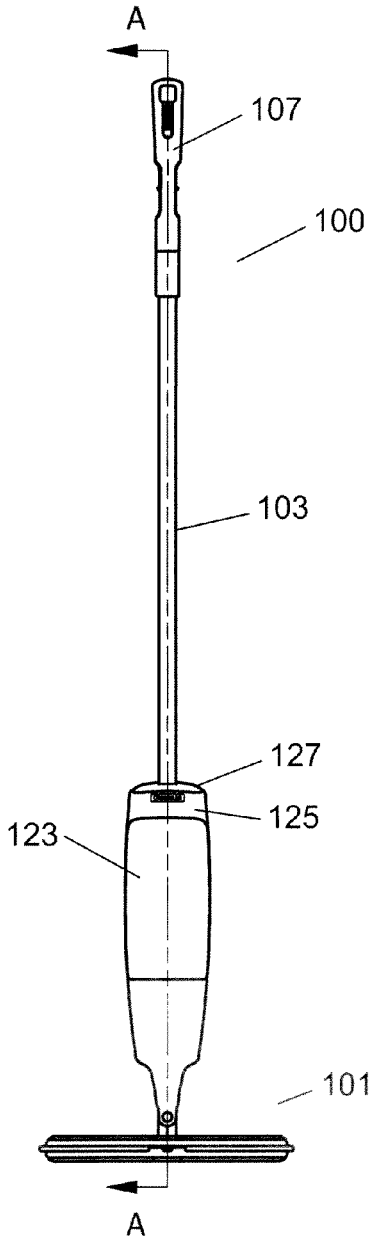
FIG. 3 is a front plan view of the double sided spray mop.

FIG. 3 is a front plan view of the double sided spray mop that also depicts the placement of the bottle 123 within the body 125.

Figure 4:
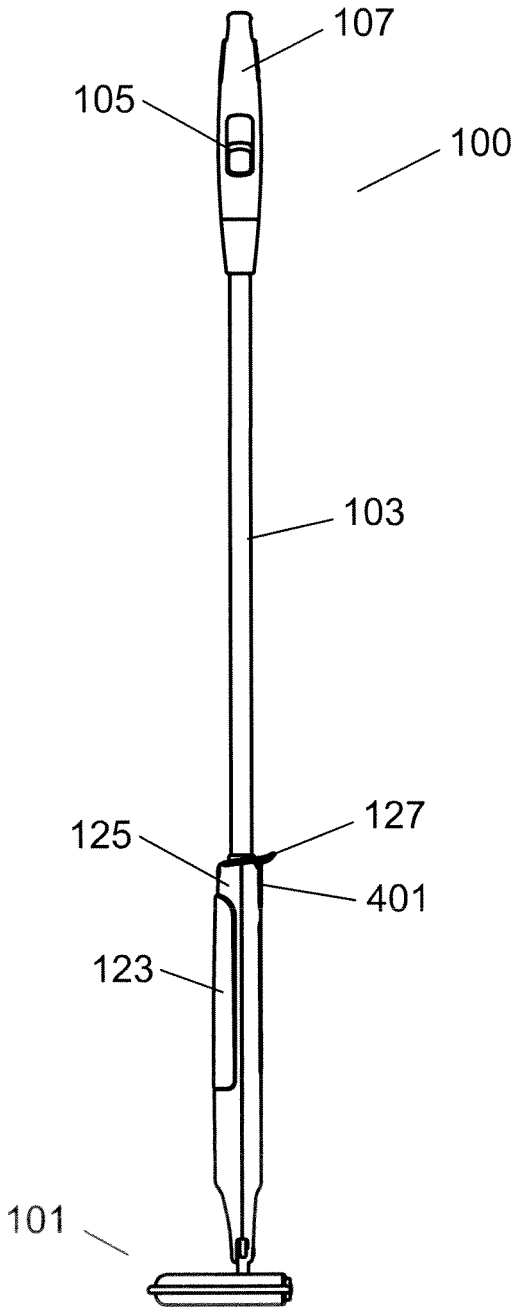
FIG. 4 is a side plan view of the double sided spray mop.

FIG. 4 is a side plan view of the double sided spray mop that is generally symmetrical to the opposite side plan view of FIG. 2.

Figure 5:
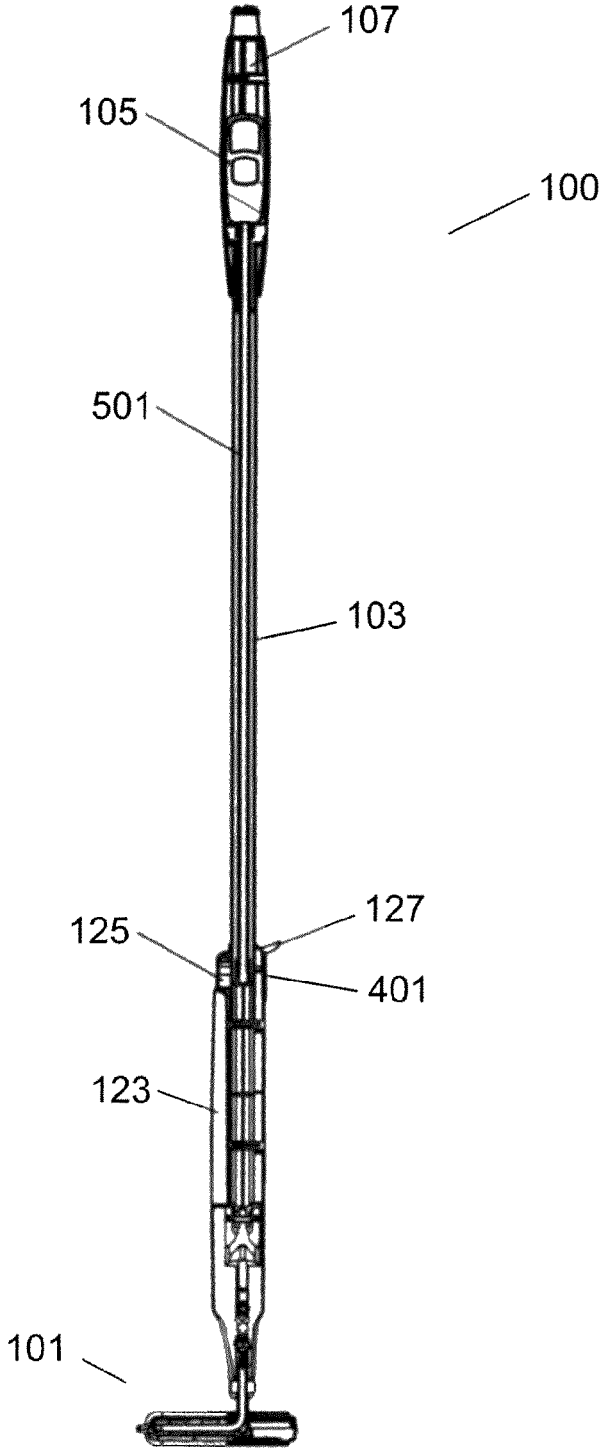
FIG. 5 is a cutaway side plan view of the double sided spray mop taken along line A-A of FIG. 3.

FIG. 5 is a cutaway side plan view of the double sided spray mop taken along line A-A of FIG. 3. The cutaway view clearly shows the pusher rod 501 that is mechanically engaged with the trigger 105 to create linear movement necessary to drive the positive displacement pump used to dispense liquid cleaning solution through the nozzle.

Figure 6:
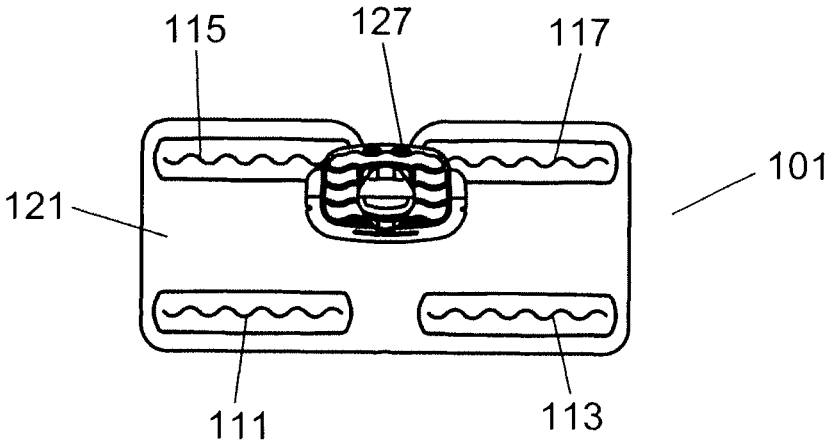
FIG. 6 is a plan view of the double sided spray mop looking down from the handle.
Figure 7:
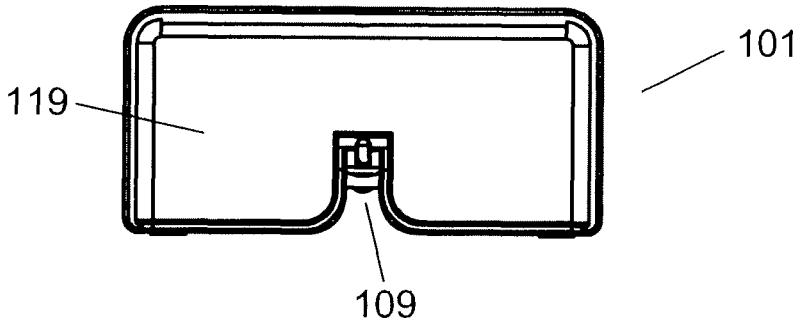
FIG. 7 is a plan view of the double sided spray mop looking up from the bottom.

For clarity, FIG. 6 is a plan view of the double sided spray mop looking down from the handle and FIG. 7 is a plan view of the double sided spray mop looking up from the bottom.

Figure 8:
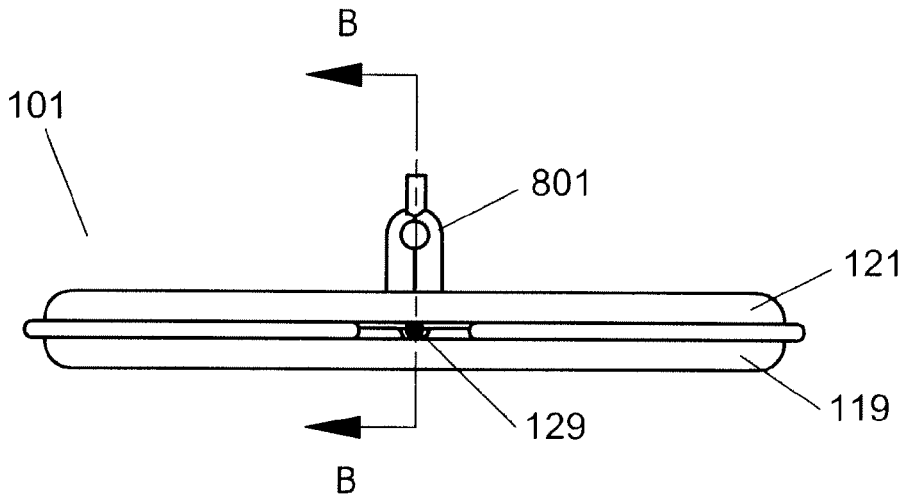
FIG. 8 is a front edge plan view of the cleaning head of the double sided spray mop.
Figure 9:
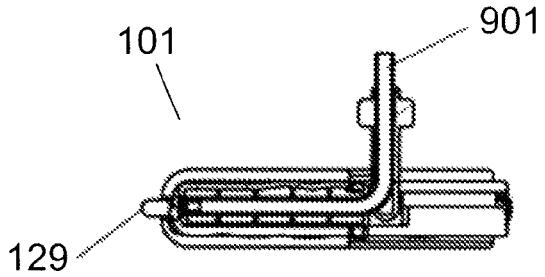
FIG. 9 is a cutaway view of the cleaning head taken along line BB of FIG. 8.

FIG. 8 is a front edge plan view of the cleaning head of the double sided spray mop. The universal joint cleaning head part 801 can be seen. This part, when joined with the universal joint body part 1805 (see FIG. 18) makes up the universal joint 109. The universal joint cleaning head part 801 has two rounded protrusions, one on each side, that engage with similar rounded openings on the universal joint body part 1805 to create the pivotal structure of the universal joint itself. Also depicted in FIG. 8 is the spray tube 901 (see FIG. 9), cut off in the figure for clarity. FIG. 9 is a cutaway view of the cleaning head taken along line B-B of FIG. 8. The spray tube 901, cut off for clarity, is depicted and can be seen terminating at the nozzle 129. The exemplary embodiment of the present invention depicts a single nozzle 129, however, multiple nozzles may be employed through junctions with the spray tube 901.

Figure 10:
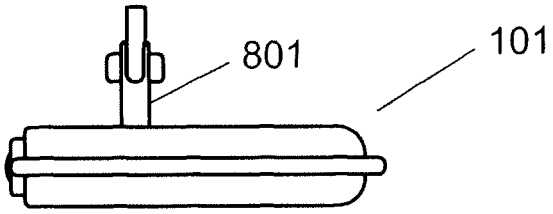
FIG. 10 is a side edge plan view of the cleaning head of the double sided spray mop.
Figure 11:
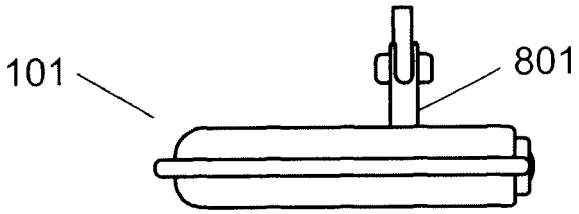
FIG. 11 is an opposite side edge plan view of the cleaning head of the double sided spray mop.

FIG. 10 is a side edge plan view of the cleaning head of the double sided spray mop and FIG. 11 is an opposite side edge plan view of the cleaning head of the double sided spray mop. Both FIG. 10 and FIG. 11 depict the cleaning head detached from the body for clarity.

Figure 12:
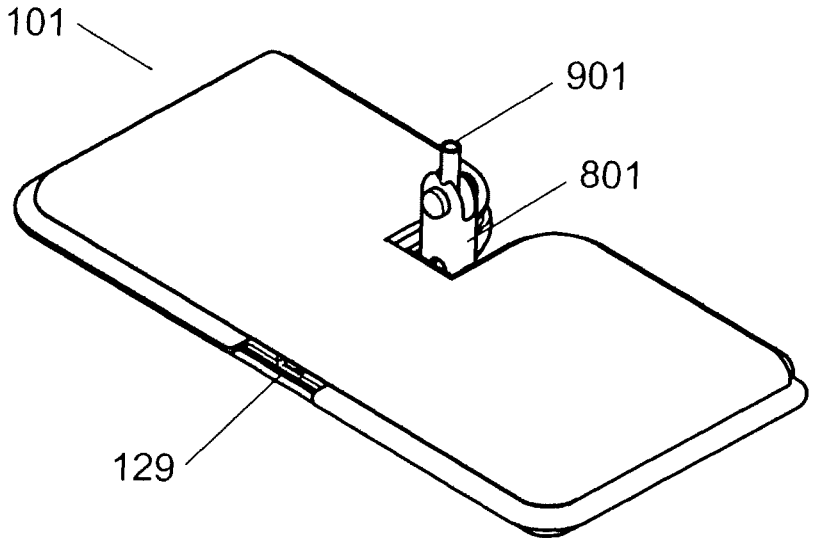
FIG. 12 is a perspective view of the cleaning head of the double sided spray mop.

FIG. 12 is a perspective view of the cleaning head of the double sided spray mop showing the bottom head 119.

Figure 13:
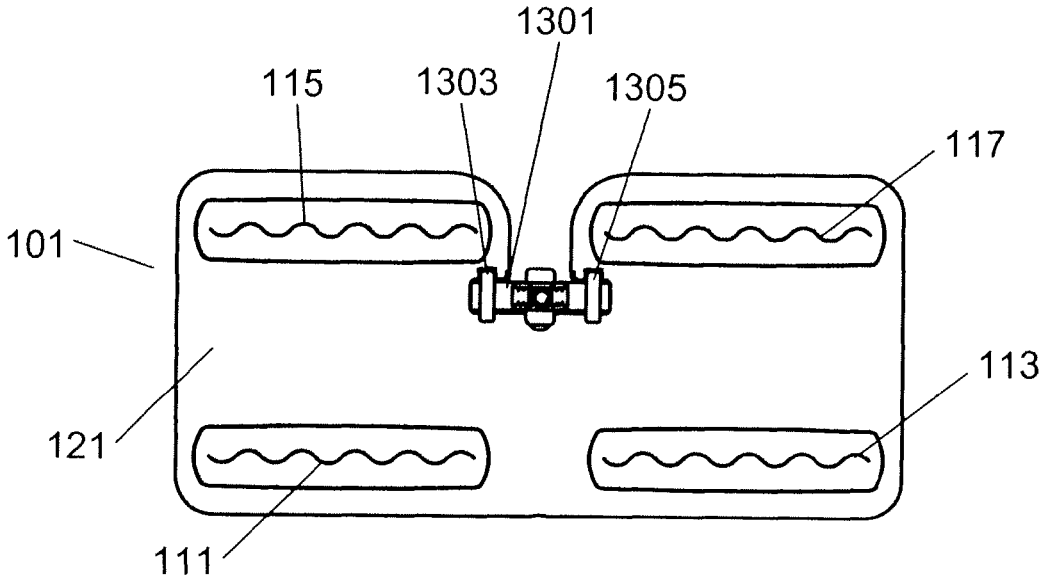
FIG. 13 is a top plan view of the cleaning head of the double sided spray mop.

FIG. 13 is a top plan view of the cleaning head of the double sided spray mop that shows the top head 121 with four push fit zippers 111, 113, 115 and 117. In other embodiments of the present invention, there may be more or less push fit zippers. Also depicted in FIG. 13 is the universal joint cleaning head part 801 fastened to the cleaning head 101. The universal joint cleaning head part 801 is depicted in FIG. 13 as being made up of its constituent components. Those components being a universal joint axle 1301 that is engaged in a similarly shaped opening in the cleaning head 101 and with sockets in the cleaning head 101 to receive each end of the universal joint axle 1301. In some embodiments of the present invention, the universal joint axle 1301 is tapered or otherwise has ends that are of a smaller diameter than the body of the universal joint axle 1301. In some embodiments of the present invention, the universal joint axle 1301 also has a first cam 1303 and a second cam 1305. In some embodiments of the present invention, there may be more or fewer cams. The cams are of a truncated circular shape and travel in a similar shaped space in the cleaning head 101. The space in the cleaning head 101 that accommodates each cam does not allow for complete rotational freedom of the universal joint axle 1301, but rather, has a stop in the space that engages with the truncated edge of the circular cam to prevent excess or undue rotation, thus keeping the cleaning head 101 in the correct position for cleaning.

Figure 14:
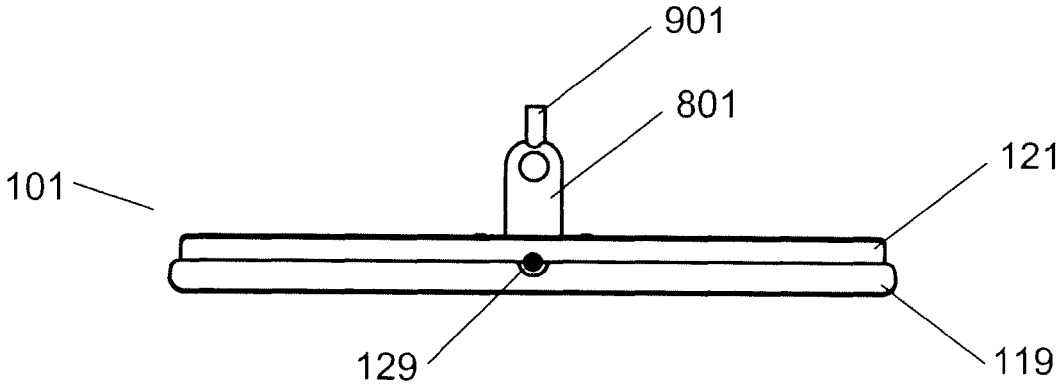
FIG. 14 is a front edge plan view of the cleaning head of the double sided spray mop.

FIG. 14 is a front edge plan view of the cleaning head of the double sided spray mop with the top head 121 facing up.

Figure 15:
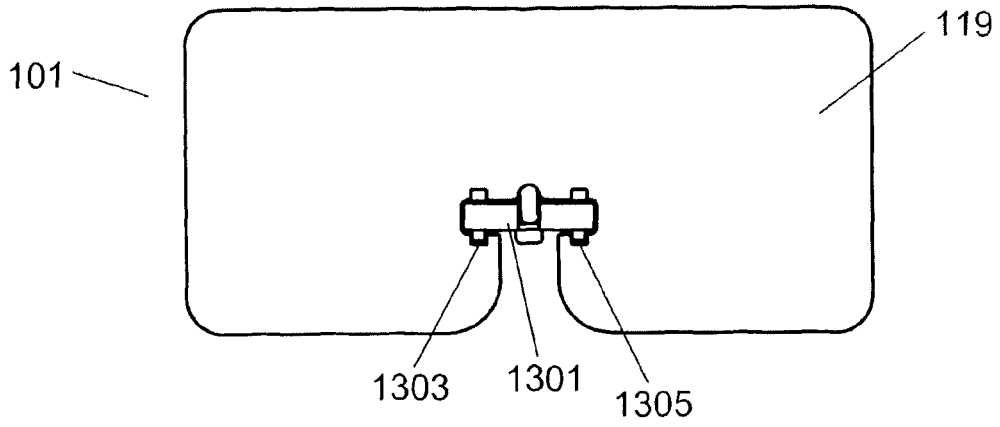
FIG. 15 is a bottom plan view of the cleaning head of the double sided spray mop.

FIG. 15 is a bottom plan view of the cleaning head of the double sided spray mop with the bottom head 119 facing up.

Figure 16:
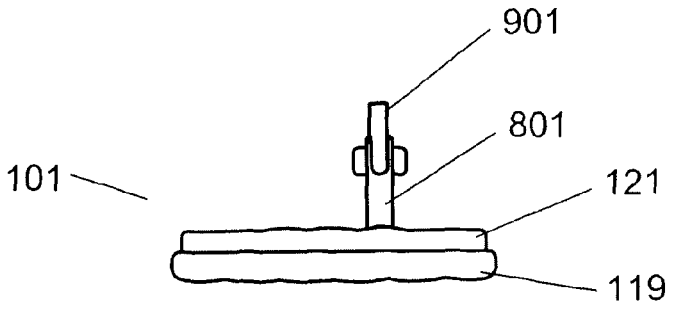
FIG. 16 is a side edge plan view of the cleaning head of the double sided spray mop.

FIG. 16 is a side edge plan view of the cleaning head of the double sided spray mop with the bottom head 119 facing down. The ridges on the bottom head 119 and also the top head 121 can be seen.

Figure 17:
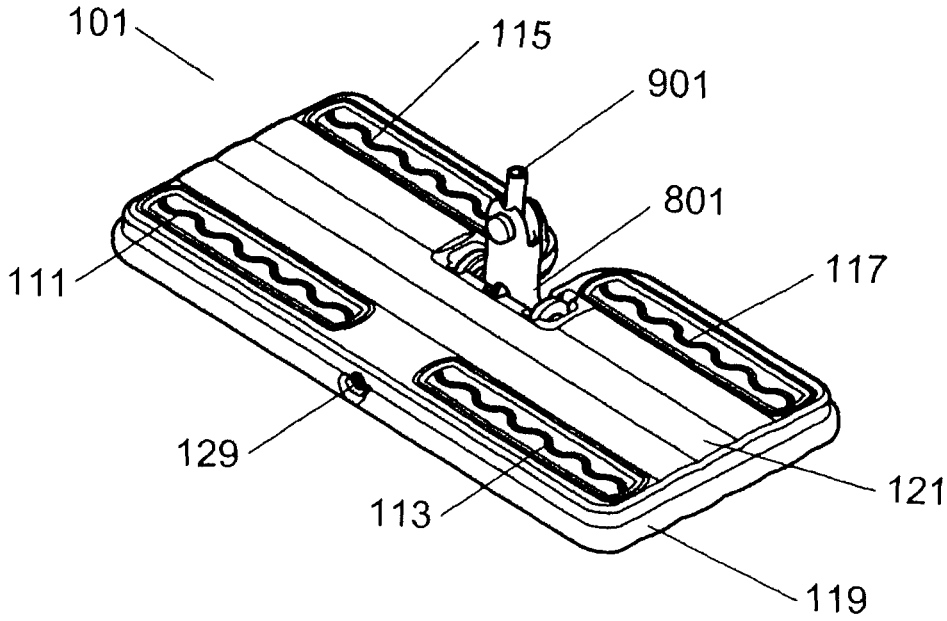
FIG. 17 is a perspective view of the cleaning head of the double sided spray mop.

FIG. 17 is a perspective view of the cleaning head of the double sided spray mop detached from the body.

Figure 18:
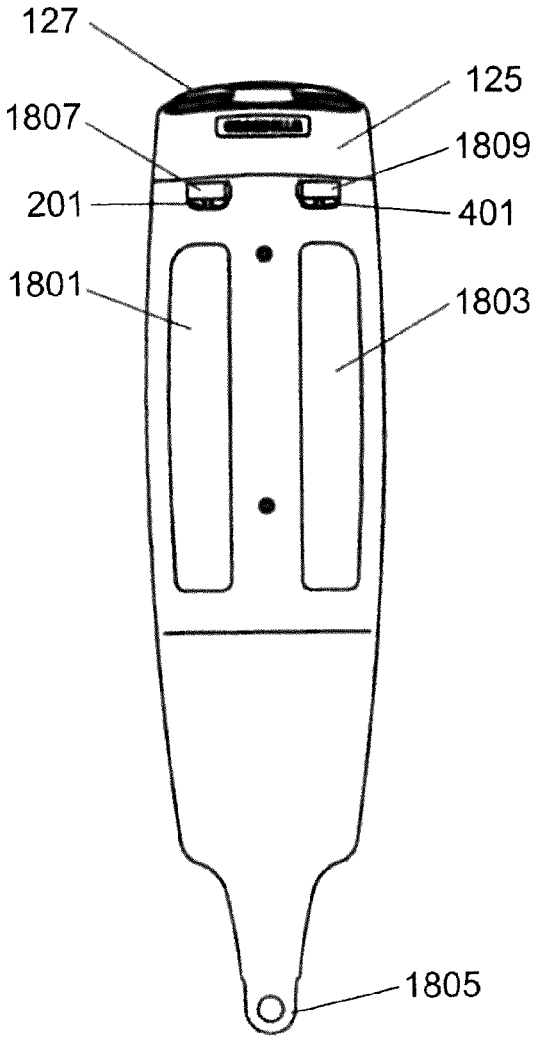
FIG. 18 is a rear front plan view of the body of the double sided spray mop.

The body 125, as previously depicted in FIG. 1, is mechanically coupled to the cleaning head 101 by way of a universal joint 109 as previously depicted and described. For a complete and accurate understanding of the body 125 and its related components and functionality, FIGS. 18-21 depict the body 125 detached from the cleaning head 101, and with the pole 103 and the bottle 123 removed. FIG. 18 is a rear plan view of the body of the double sided spray mop. The body 125 may be made from a material such as a rigid material, for example a plastic or a metal. Examples of suitable plastics include acrylonitrile butadiene styrene (ABS), polyethylene, polypropylene, polystyrene, polyvinyl chloride, polytetrafluoroethylene, and the like. Bioplastics may also be used in some embodiments of the present invention. In addition, reinforced plastics, metals, and other materials that may be suitably formed may also be used. The body 125 may be made by injection molding, blow molding, machining, or the like. A universal body joint part 1805 can be seen toward the bottom of the body 125. This universal body joint part 1805 mates with the universal joint cleaning head part 801, as depicted in FIG. 8, to make up the universal joint 109 depicted in FIG. 1.

Figure 19:
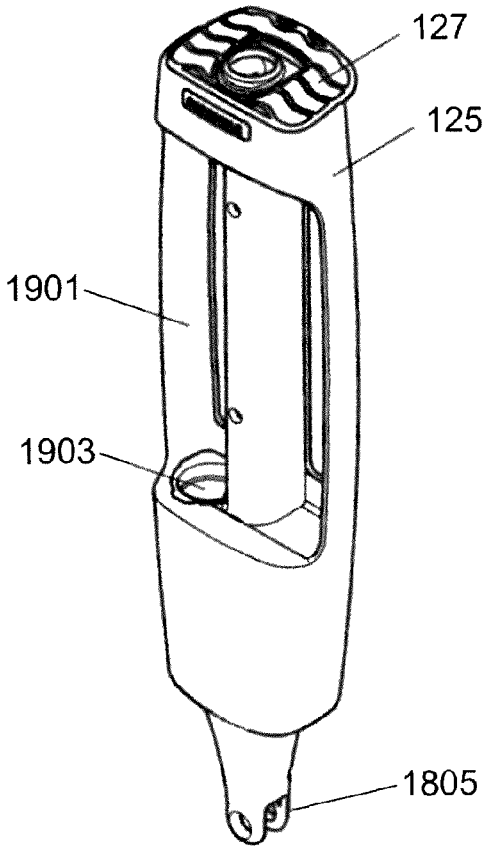
FIG. 19 is a perspective view of the body of the double sided spray mop.

As seen in FIGS. 18 and 19, the universal body joint part 1805 has two lobes, each lobe having a hole. The universal joint cleaning head part 801 has protrusions that engage with the hole in each lobe, creating a complete and functional universal joint 109. Also depicted in FIG. 18 is a first viewing aperture 1801 and a second viewing aperture 1803 to allow a user to determine the level of liquid remaining in the bottle 123 (not shown in FIG. 18, see FIG. 1) and also to view any additional markings that may be placed on, or molded into, the bottle 123. Markings may include fluid level indicators, type of cleaning solution indicators, markings indicating the location where the cleaning solution contained in the bottle should be used, and the like.

Figure 20:
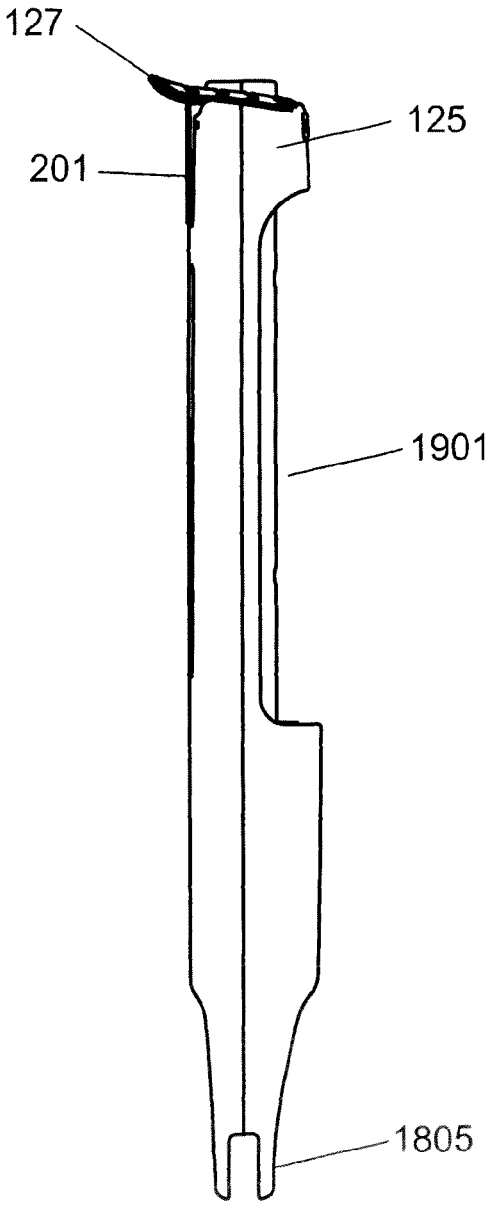
FIG. 20 is a side view of the body of the double sided spray mop.
Figure 21:
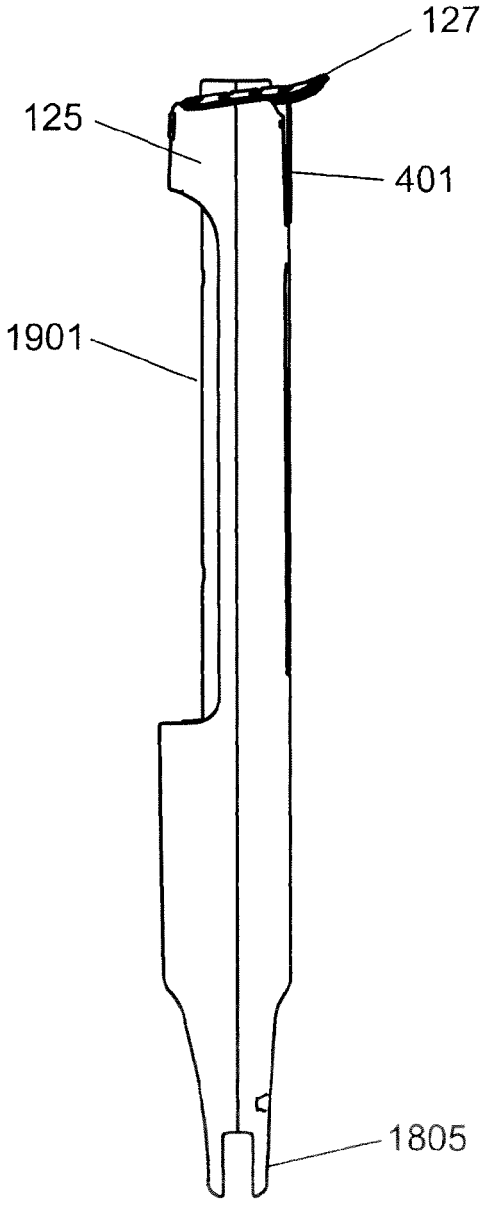
FIG. 21 is an opposite side view of the body of the double sided spray mop.
Figure 29:
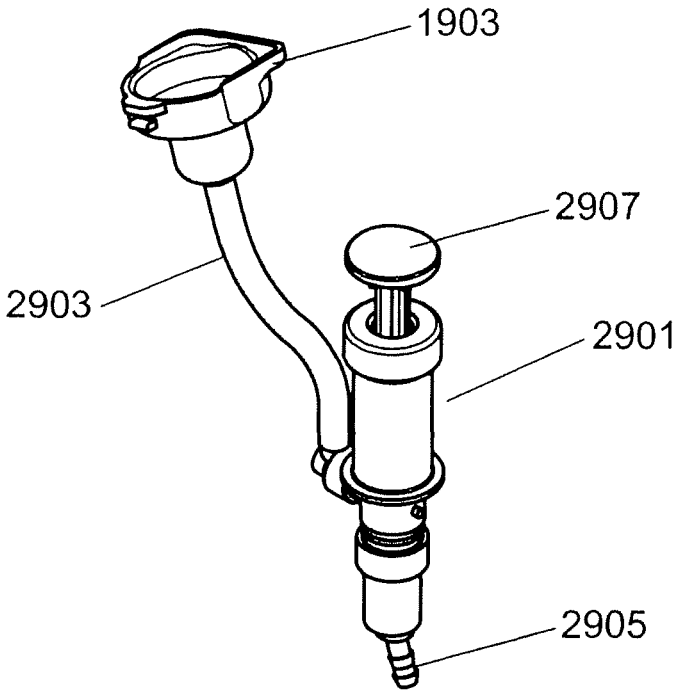
FIG. 29 is a perspective view of a pump of the double sided spray mop.

FIG. 19 is a perspective view of the body of the double sided spray mop. With the bottle removed, one can see the bottle opening 1901. In some embodiments of the present invention, the bottle opening 1901 is bisected by a protrusion that contains the pole. As such, the bottle itself will have a generally linear and transverse depression to accommodate the pole protrusion. Also seen in FIG. 19 within the bottle opening 1901 is a bottle coupler receiver 1903 that receives the coupler 2201 attached to the bottle (not shown in FIG. 19, see FIG. 22). The bottle coupler receiver 1903 is in fluid communication with the pump 2901, as seen in FIG. 29. The body lever 127, as previously described and depicted, has at least one retention tab that couples to a retention slot in the bottle, and also is hingeably connected to the body 125 such that when the body lever 127 is depressed or otherwise moved, it will push at least part of the bottle 123 (see FIG. 1) out of the body 125 for subsequent replacement, refilling, or the like. The body lever 127 may be made from a material such as a rigid material, for example a plastic or a metal. Examples of suitable plastics include acrylonitrile butadiene styrene (ABS), polyethylene, polypropylene, polystyrene, polyvinyl chloride, polytetrafluoroethylene, and the like. Bioplastics may also be used in some embodiments of the present invention. In addition, reinforced plastics, metals, and other materials that may be suitably formed may also be used. The body lever 127 may be made by injection molding, blow molding, machining, or the like. FIG. 20 is a side view of the body of the double sided spray mop and FIG. 21 is an opposite side view of the body of the double sided spray mop.

Figure 22:
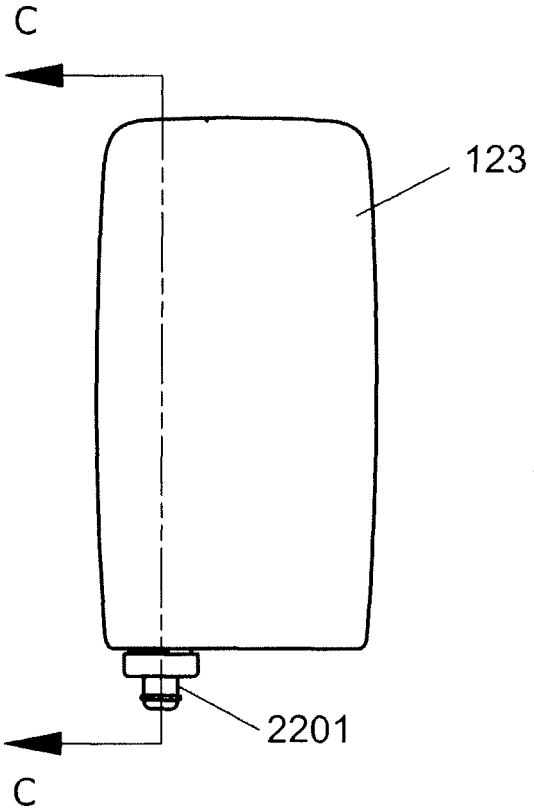
FIG. 22 is a plan view of the bottle of the double sided spray mop.

FIGS. 22-28 depict the bottle 123 in various views. The bottle 123 is molded or otherwise formed from a plastic such as high density polyethylene (HDPE), low density polyethylene (LDPE), polyethylene terephthalate (PET, PETE), polyvinyl chloride (PVC), Polypropylene (PP), polystyrene (PS), or from glass, stainless steel, aluminum, or the like. The bottle 123 is molded with features to accommodate the novel retention system of the body 125. In use, the bottle 123 is placed with its opening down into the bottle opening 1901 of the body 125. FIG. 22 is a plan view of the bottle of the double sided spray mop. A bottle coupler 2201 can be seen in FIG. 22, which is a closure for the bottle and contains a nipple and o-ring arrangement that in use is inserted into the bottle coupler receiver 1903 to deliver fluid to the pump and nozzle system of the present invention.

Figure 23:
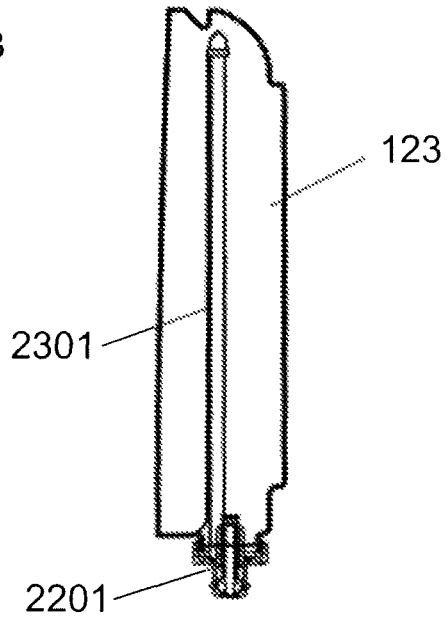
FIG. 23 is a side view of the bottle of the double sided spray mop.

FIG. 23 is a side view of the bottle of the double sided spray mop. As some embodiments of the present invention employ transparent or translucent plastic, a vent tube 2301 can be seen within the bottle 123. The vent tube 2301 terminates on the bottle coupler 2201 by way of a hole or aperture through the bottle coupler 2201. The hole or aperture through the bottle coupler 2201 provides make up air within the bottle 123 so that as fluid is dispensed, air will displace the void created by the dispensed liquid, preventing suction and other related difficulties with liquid dispensing.

Figure 24:
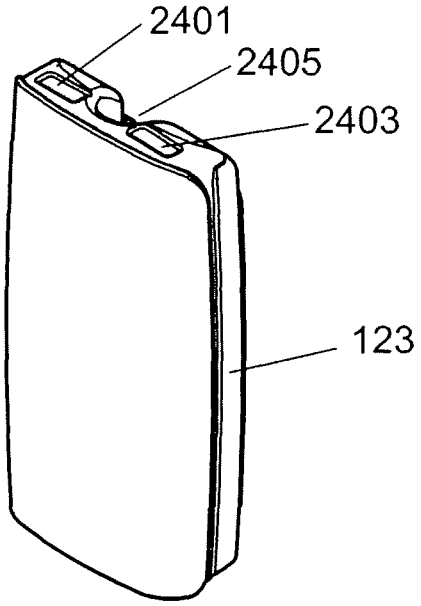
FIG. 24 is a perspective view of the bottle of the double sided spray mop.

Turning now to FIG. 24, a perspective view of the bottle of the double sided spray mop is depicted. As previously stated, in some embodiments of the present invention the bottle opening 1901 is bisected by a protrusion that contains the pole. As such, the bottle itself will have a generally linear and transverse depression forming a bottle conformal channel 2405 to accommodate the pole protrusion. This bottle conformal channel 2405 can be seen in FIG. 24, and also in FIGS. 25 and 26. Also shown in FIG. 24 are a first retention slot 2401 and a second retention slot 2403. The body lever 127 (depicted in FIG. 1 and subsequent drawings) has at least one retention tab that couples to a retention slot in the bottle, and also is hingeably connected to the body such that when the body lever 127 is depressed or otherwise moved, it will push at least part of the bottle 123 out of the body 125 (see FIG. 1) for subsequent replacement, refilling, or the like. The first retention slot 2401 and the second retention slot 2403 serve to engage with retention tabs on the body lever 127 to retain the bottle in the body until such time as the body lever 127 is pushed to remove the bottle from the body.

Figure 25:
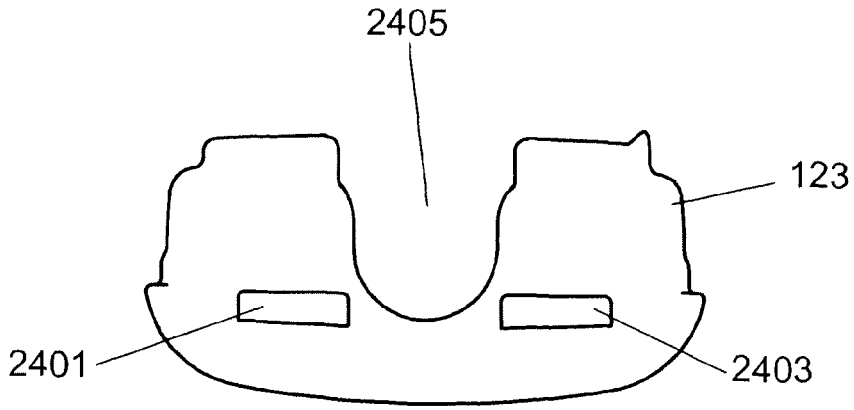
FIG. 25 is a top plan view of the bottle of the double sided spray mop.

FIG. 25 is a top plan view of the bottle of the double sided spray mop that clearly shows the first retention slot 2401, the second retention slot 2403, and the bottle conformal channel 2405.

Figure 26:
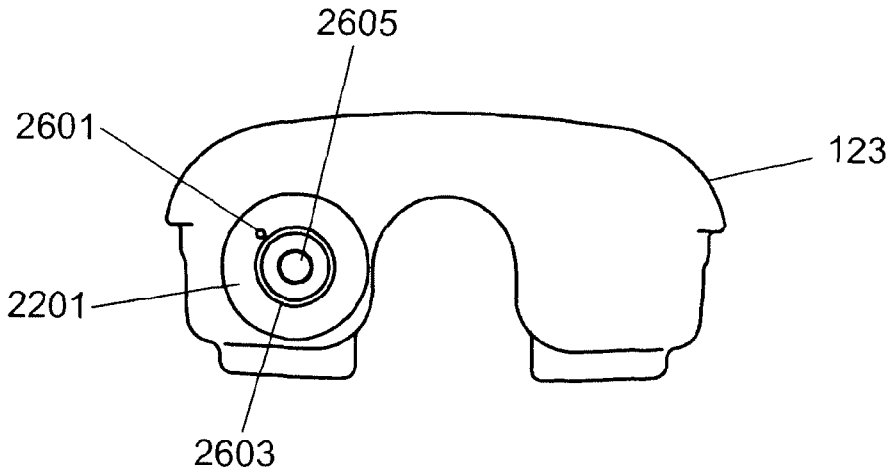
FIG. 26 is a bottom plan view of the bottle of the double sided spray mop.
Figure 27:
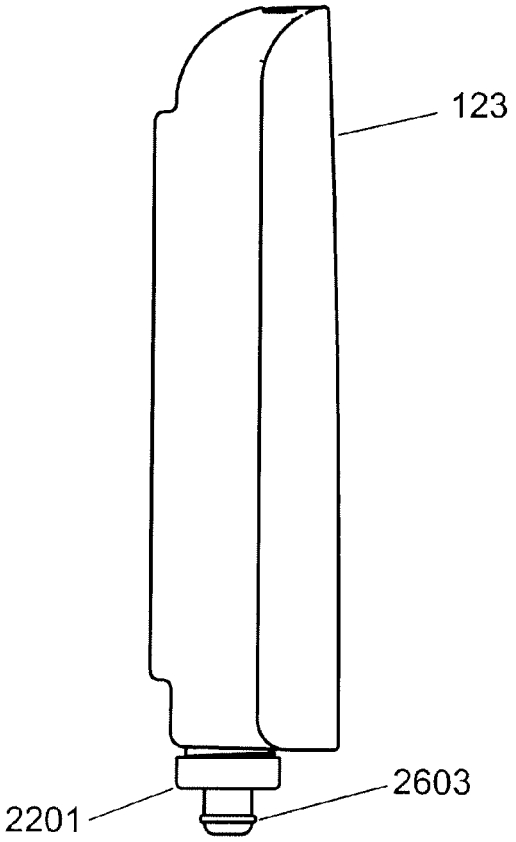
FIG. 27 is a side plan view of the bottle of the double sided spray mop.
Figure 28:
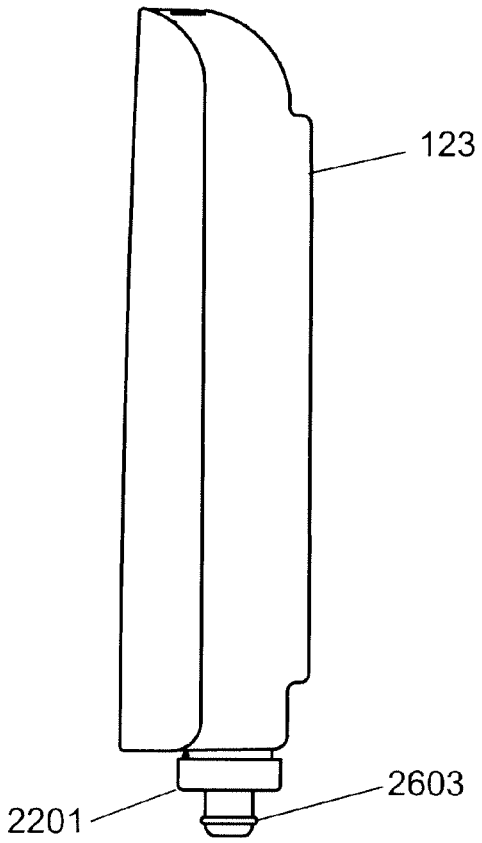
FIG. 28 is an opposite side plan view of the bottle of the double sided spray mop.

FIG. 26 is a bottom plan view of the bottle of the double sided spray mop. The constituent parts of the bottle coupler 2201 (see FIG. 22) are depicted. A vent hole 2601 is connected to the vent tube 2301 (see FIG. 23). To ensure a leak proof seal when the bottle 123 is placed in operation within the body 125, an o-ring 2603 is placed about a male fitting 2605. FIG. 27 is a side plan view of the bottle of the double sided spray mop and FIG. 28 is an opposite side plan view of the bottle of the double sided spray mop.

As previously described, a pump is housed within the body, the pump being in fluid communication between the bottle coupler receiver and the nozzle for delivery of a cleaning solution. To operate the pump, a pusher rod is placed between a trigger and a linkage. The linkage is mechanically coupled to the pump such that movement of the trigger translates to actuation of the pump. FIG. 29 is a perspective view of an example of a pump of the double sided spray mop. The pump can be any positive displacement pump were movement of a push stem, valve, plunger, piston, impeller, diaphragm, or similar positive displacement structure in turn moves liquid from the bottle to the nozzle. The bottle coupler receiver 1903 can be seen in FIG. 29 attached to a feed tube 2903 that is in turn connected to the pump 2901. A supply fitting 2905 can be seen. A piece of tubing or similar fluid transmitting structure is attached to the supply fitting 2905 to transfer fluid to a nozzle or similar structure for subsequent expulsion of the liquid during a cleaning operation. A push stem 2907 can also be seen where movement of the push stem 2907 causes positive displacement within the pump 2901 and subsequent delivery of liquid.

Figure 30:
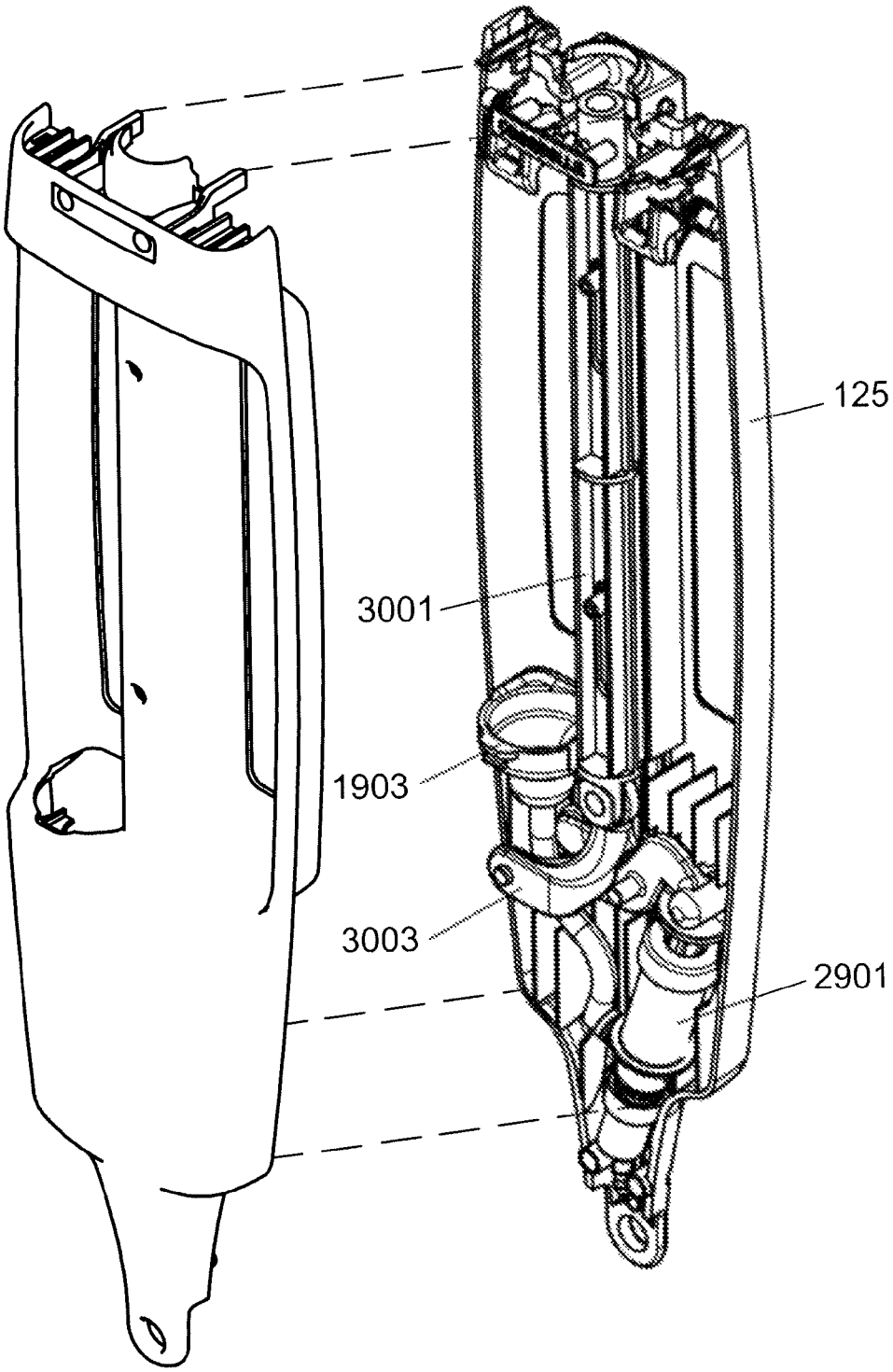
FIG. 30 is an exploded perspective view of the body of the double sided spray mop.

FIG. 30 is an exploded perspective view of the body of the double sided spray mop. As can be seen, the body 125 is made in several pieces to facilitate assembly and also placement of a pump and related mechanical components within the body 125. The pump 2901, as previously described by way of FIG. 29, can be seen. In addition, a pusher 3001 can be seen mechanically coupled to a linkage 3003 that in turn translates pulling motion of the trigger into a pushing motion required for positive displacement of the fluid within the pump 2901. The pusher 3001 and related linkage 3003 may be made from a plastic such as polypropylene or the like, or may also be made of a metal such as steel or aluminum. The pusher 3001 is in turn mechanically coupled to the pusher rod 501 (see FIG. 5) that is in turn connected to the trigger (see FIG. 1).

Figure 31:
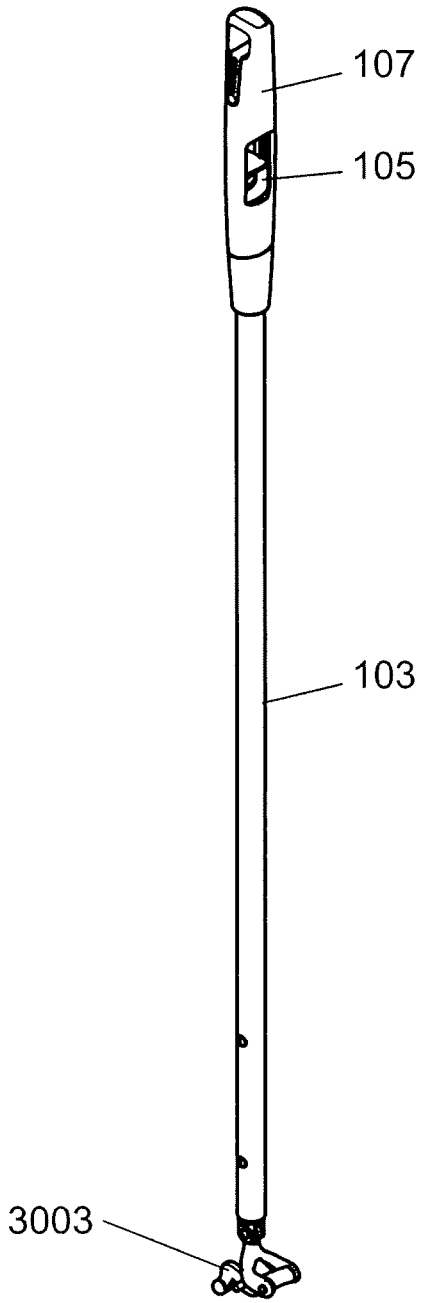
FIG. 31 is a perspective view of the handle and linkage assembly of the double sided spray mop.

Lastly, FIG. 31 is a perspective view of the handle and linkage assembly of the double sided spray mop. The pusher rod 501 is contained within the pole 103 and cannot be seen in FIG. 31. However, the linkage 3003 can be seen, as well as the trigger 105 and the handle 107.

To use the double sided spray mop, liquid such as a cleaning solution is placed within the bottle 123. A cleaning sheet or pad is attached to the cleaning head, and a suitable amount of liquid is expelled from the cleaning head nozzle using a mechanically actuated pump driven by a trigger contained within a handle. The double sided spray mop is then moved across the floor or similar surface until clean. The cleaning head may be flipped so that both sides may be used in cleaning. The novel details of construction of the double sided spray mop being heretofore provided and depicted.

It is, therefore, apparent that there has been provided, in accordance with the various objects of the present invention, a double sided spray mop. While the various objects of this invention have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of this specification, claims and the attached drawings.

What is claimed is:

1. A double sided spray mop comprising:

a cleaning head comprising a bottom head, a top head having at least one push fit zipper, a universal joint cleaning head part, and a spray tube between the bottom head and the top head, the spray tube terminating with a nozzle protruding from an edge of the cleaning head for delivery of a cleaning solution;

a body comprising a bottle opening, a universal joint body part, a body lever, and a bottle coupler receiver;

the universal joint body part being mechanically coupled to the universal joint cleaning head part;

a pole connected to the body;

a pump housed within the body and in fluid communication between the bottle coupler receiver and the nozzle for delivery of a cleaning solution; and a pusher rod placed between a trigger and a linkage, the linkage being mechanically coupled to the pump such that movement of the trigger translates to actuation of the pump.

2. The double sided spray mop of claim 1, further comprising a bottle having a bottle coupler and fitted to the bottle opening of the body.

3. The double sided spray mop of claim 2, wherein the bottle has at least one retention slot.

4. The double sided spray mop of claim 2, wherein the bottle has a conformal channel that straddles the pole when placed in the bottle opening of the body.

5. The double sided spray mop of claim 2, wherein the bottle contains cleaning solution.

6. The double sided spray mop of claim 1, wherein the body lever has at least one actuator tab for engaging with the retention slot of the bottle.

7. The double sided spray mop of claim 1, wherein the body lever has at least one push lever for disengaging the bottle from the body.

8. The double sided spray mop of claim 1, further comprising a handle.

9. The double sided spray mop of claim 8, wherein the trigger is within the handle.

10. The double sided spray mop of claim 1, wherein the at least one push fit zipper has a curvilinear opening.

11. The double sided spray mop of claim 1, wherein the bottom head has a plurality of ridges.

12. The double sided spray mop of claim 1, further comprising a disposable cleaning pad.

13. The double sided spray mop of claim 1, further comprising a disposable cleaning pad impregnated with a cleaning solution.

14. The double sided spray mop of claim 1, further comprising a reusable cleaning pad.

15. A cleaning kit comprising:

the double sided spray mop of claim 1; and a disposable cleaning pad.

16. The cleaning kit of claim 15, further comprising a bottle containing cleaning solution.

17. A double sided spray mop comprising:

a body comprising a universal joint body part, a bottle opening with a bottle coupler receiver, and a body lever with at least one actuator tab and at least one push lever;

a cleaning head comprising a bottom head, a top head, a universal joint cleaning head part coupled to the universal joint body part, and a spray tube between the bottom head and the top head, the spray tube terminating with a nozzle for delivery of a cleaning solution;

a pump in fluid communication with the bottle coupler receiver and the nozzle; and a pole connected to the cleaning head.

18. The double sided spray mop of claim 17, further comprising a bottle having a bottle coupler and fitted to the bottle opening in the body.

19. The double sided spray mop of claim 17, wherein the pump is a mechanical pump.

20. The double sided spray mop of claim 17, further comprising a cleaning pad.

* * * * *